US005500969A

United States Patent [19]

Bonislawski, Jr.

[11] Patent Number: 5,500,969

[45] Date of Patent: Mar. 26, 1996

[54] DUAL POLARITY COMMUTATED ROLL ELCTROSTATIC CLEANER WITH ACOUSTIC TRANSFER ASSIST

[75] Inventor: John M. Bonislawski, Jr., Ontario, N.Y.

[73] Assignee: Xerox Corporation, Stamford, Conn.

[21] Appl. No.: 327,933

[22] Filed: Oct. 24, 1994

[51] Int. Cl.[6] ..... G03G 21/00

[52] U.S. Cl. ..... 15/1.51; 355/297; 355/303; 15/256.5

[58] Field of Search ..... 355/305, 297, 355/296, 303; 15/256.52, 1.51, 256.5

[56] References Cited

U.S. PATENT DOCUMENTS

| | | | |
|---|---|---|---|
| 3,257,224 | 6/1966 | Jous et al. | 117/17.5 |
| 3,572,923 | 3/1971 | Fisher et al. | 355/303 X |
| 3,848,994 | 11/1974 | Fraser | 355/303 X |
| 4,111,546 | 9/1978 | Maret | 355/297 |
| 4,975,748 | 12/1990 | Koinuma et al. | 355/305 |
| 5,025,291 | 6/1991 | Nowak et al. | 355/296 X |
| 5,030,999 | 7/1991 | Lindblad et al. | 355/297 |
| 5,065,194 | 11/1991 | Sonnenberg | 355/296 |
| 5,282,008 | 1/1994 | Ellingham et al. | 355/305 |
| 5,363,183 | 11/1994 | Reese et al. | 355/305 |

OTHER PUBLICATIONS

Xerox Disclosure Journal, vol. 18, No. 3, May/Jun. 1993, entitled "Acoustical Vacuum Cleaner Assist".

*Primary Examiner*—Nestor R. Ramirez
*Attorney, Agent, or Firm*—T. L. Fair

[57] ABSTRACT

A dual polarity commutated roll attracts toner and debris particles loosened into a particle cloud from the photoreceptor surface by an acoustical horn. The particles are attracted to and adhere to the commutated roll, whether right or wrong sign (i.e. positive or negative), and are removed from the roll, as the roll rotates, by a scraper blade. The particles are collected in a waste container as the particles are removed from the roll surface by the scraper blade. Residual particles that are not attracted to the commutated roll, are removed from the photoreceptor surface by a spots blade. The cleaning system does not contact the photoreceptor, thus, increasing cleaner and photoreceptor life.

11 Claims, 2 Drawing Sheets

DUAL POLARITY COMMUTATED ROLL ELCTROSTATIC CLEANER WITH ACOUSTIC TRANSFER ASSIST

BACKGROUND OF THE INVENTION

This invention relates generally to an electrostatographic copier or printer, and more particularly, concerns a cleaning apparatus.

In an electrophotographic application such as xerography, a charge retentive surface (i.e., photoconductor, photoreceptor or imaging surface) is electrostatically charged, and exposed to a light pattern of an original image to be reproduced to selectively discharge the surface in accordance therewith. The resulting pattern 0f charged and discharged areas on that surface form an electrostatic charge pattern (an electrostatic latent image) conforming to the original image. The latent image is developed by contacting it with a finely divided electrostatically attractable powder referred to as "toner". Toner is held on the image areas by the electrostatic charge on the surface. Thus, a toner image is produced in conformity with a light image of the original being reproduced. The toner image may then be transferred to a substrate (e.g., paper), and the image affixed thereto to form a permanent record of the image to be reproduced. Subsequent to development, excess toner left on the charge retentive surface is cleaned from the surface. The process is well known, and useful for light lens copying from an original, and printing applications from electronically generated or stored originals, where a charge surface may be imagewise discharged in a variety of ways. Ion projection devices where a charge is imagewise deposited on a charge retentive substrate operates similarly.

Although a preponderance of the toner forming the image is transferred to the paper during transfer, some toner invariably remains on the charge retentive surface, it being held thereto by relatively high electrostatic and/or mechanical forces. Additionally, paper fibers, Kaolin and other debris have a tendency to be attracted to the charge retentive surface. It is essential for optimum operation that the toner remaining on the surface be cleaned thoroughly therefrom.

Conventional cleaning methods for cleaning this residual toner include contact cleaners (i.e. cleaners that frictionally contact the imaging surface) such as blades and brushes. The contact between these cleaners and the surface being cleaned, decrease the wear life of both the cleaner and the photoreceptor. This frictional contact can cause tearing and chipping to the cleaning blade edge which leads to cleaning failures and possible damage to the photoreceptor. The cleaning brushes often develop a set due to contact with the imaging surface, that affects the ability of the brush to clean the surface.

The following disclosures may be relevant to various aspects of the present invention and may be briefly summarized as follows:

U.S. Pat. No. 3,257,224 to Jous et al. which discloses a magnetic roller that dips into developer powder contained in a trough beneath the roller. The iron filings, carrying the toner on their surfaces, adhere in brush-like formation to the magnetic poles of the roller and are applied in this form by rotation of the roller to the surface of a charged electrophotographic material which has been exposed imagewise and is traversed over the roller. The toner is attracted electrostatically from the magnet to the photoconductive coating of the electrophotographic material and a visible image is formed.

U.S. Pat. No. 4,111,546 to Maret which discloses an electrostatographic reproducing apparatus and process that includes a system for ultrasonically cleaning residual material from the imaging surface. Ultrasonic vibratory energy is applied to the air space adjacent the imaging surface to excite the air molecules for dislodging the residual material from the imaging surface. Preferably pneumatic cleaning is employed simultaneously with the ultrasonic cleaning. Alternatively, a conventional mechanical cleaning system is augmented by localized vibration of the imaging surface at the cleaning station which are provided from behind the imaging surface.

Xerox Disclosure Journal, volume 18, no.3, May/Jun. 1993, entitled "Acoustical Vacuum Cleaner Assist" discloses a high velocity and pressure vacuum that subsequently removes particles from the photoreceptor belt. The particles being previously dislodged by the vibratory action of an acoustical horn against the photoreceptor belt.

SUMMARY OF INVENTION

Briefly stated, and in accordance with one aspect of the present invention, there is provided an apparatus for cleaning particles from a surface. The surface comprises a device, in communication with the surface, for loosening the particles from the surface and, a member, positioned adjacent the surface, for attracting loosened particles thereto. The member including a plurality of segments with adjacent segments being opposite polarities for attracting particles having opposite polarities thereto.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 2:
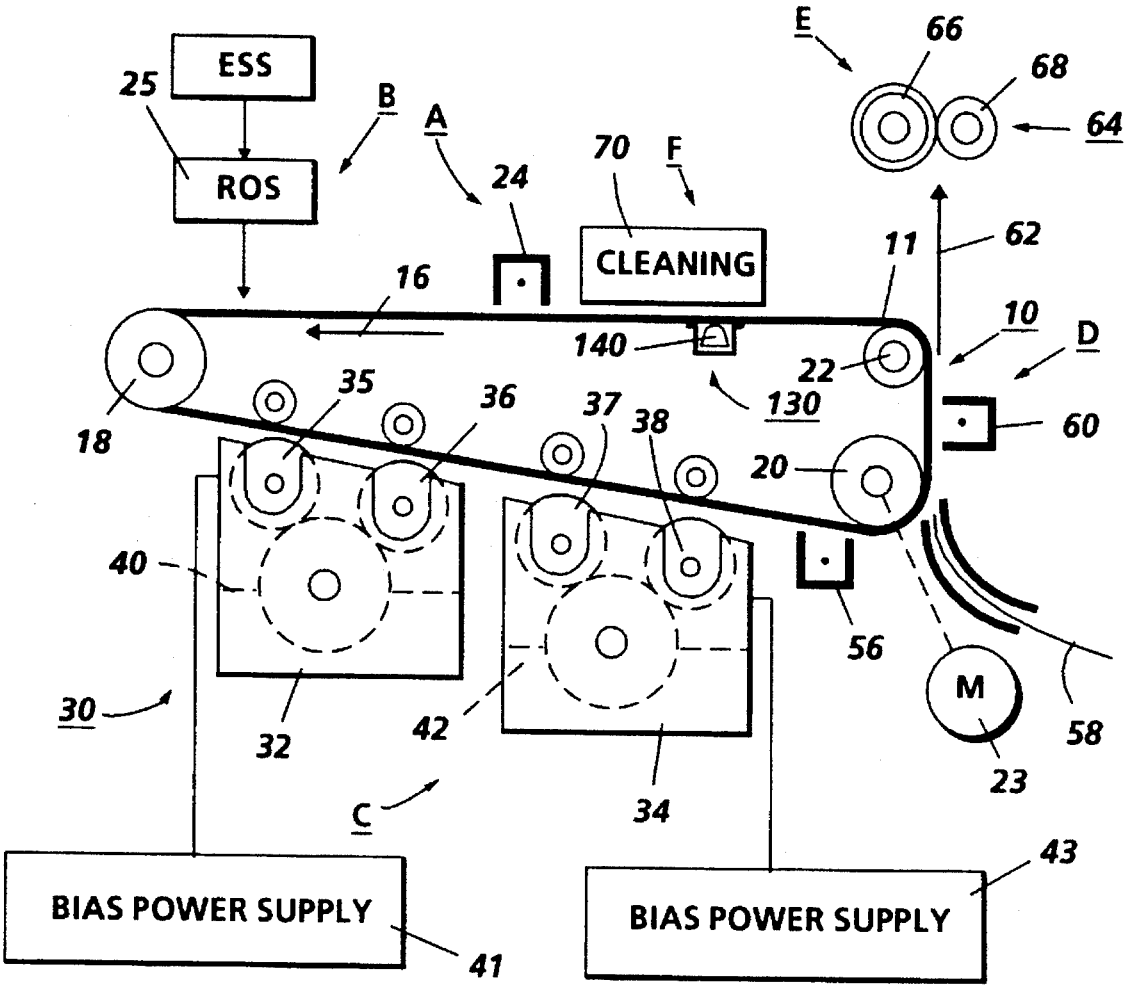
FIG. 2 is a schematic illustration of a printing apparatus incorporating the inventive features of the present invention.

Referring now to the drawings, where the showings are for the purpose of describing a preferred embodiment of the invention and not for limiting same, the various processing stations employed in the reproduction machine illustrated in FIG. 2 will be briefly described.

A reproduction machine, in which the present invention finds advantageous use, utilizes a charge retentive member in the form of a photoconductive belt 10 consisting of a photoconductive surface and an electrically conductive, light transmissive substrate mounted for movement past a charging station A, an exposure station B, developer stations C, transfer station D, fusing station E and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used to provide suitable tensioning of the photoreceptor belt 10. Motor 23 rotates roller 18 to advance belt 10 in the direction of arrow 16. Roller 20 is coupled to motor 23 by suitable means such as a belt drive.

As can be seen by further reference to FIG. 2, initially successive portions of belt 10 pass through charging station A. At charging station A, a corona discharge device such as a scorotron, corotron or dicorotron indicated generally by the reference numeral 24, charges the belt 10 to a selectively high uniform positive or negative potential. Any suitable control, well known in the art, may be employed for controlling the corona discharge device 24.

Next, the charged portions of the photoreceptor surface are advanced through exposure station B. At exposure station B, the uniformly charged photoreceptor or charge retentive surface 10 is exposed to a laser based input and/or output scanning device 25 which causes the charge retentive surface to be discharged in accordance with the output from the scanning device. Preferably the scanning device is a three level laser Raster Output Scanner (ROS). The resulting photoreceptor contains both charged-area images and discharged-area images as well as charged edges corresponding to portions of the photoreceptor outside the image areas. [The high voltage latent image is developed with positive (+) charged black toner and is called Charge Area Development (CAD). The low voltage latent image is developed with negative (–) charge color toner and Discharge Area Development (DAD)].

The photoreceptor, which is initially charged to a voltage undergoes dark decay to a voltage level. When exposed at the exposure station B it is discharged to near zero or ground potential in the highlight (i.e. color other than black) color parts of the image. The photoreceptor is also partially discharged in the background (white) image areas. After passing through the exposure station, the photoreceptor contains charged areas and discharged areas which corresponding to two images and to charged edges outside of the image areas.

At development station C, a development system, indicated generally by the reference numeral 30 advances developer materials into contact with the electrostatic latent images. The development system 30 comprises first and second developer apparatuses 32 and 34. The developer apparatus 32 comprises a housing containing a pair of magnetic brush rollers 35 and 36. The rollers advance developer material 40 into contact with the photoreceptor for developing the discharged-area images. The developer material 40, by way of example, contains negatively charged color toner. Electrical biasing is accomplished via power supply 41 electrically connected to developer apparatus 32. A DC bias is applied to the rollers 35 and 36 via the power supply 41.

The developer apparatus 34 comprises a housing containing a pair of magnetic brush rolls 37 and 38. The rollers advance developer material 42 into contact with the photoreceptor for developing the charged-area images. The developer material 42 by way of example contains positively charged black toner for developing the charged-area images. Appropriate electrical biasing is accomplished via power supply 43 electrically connected to developer apparatus 34. A DC bias is applied to the rollers 37 and 38 via the bias power supply 43.

Because the composite image developed on the photoreceptor consists of both positive and negative toner, a pretransfer corona discharge member 56 is provided to condition the toner for effective transfer to a substrate using corona discharge of a desired polarity, either negative or positive.

Sheets of substrate or support material 58 are advanced to transfer station D from a supply tray, not shown. Sheets are fed from the tray by a sheet feeder, also not shown, and advanced to transfer station D through a corona charging device 60. After transfer, the sheet continues to move in the direction of arrow 62 to fusing station E.

Fusing station E includes a fuser assembly, indicated generally by the reference numeral 64, which permanently affixes the transferred toner powder images to the sheets. Preferably, fuser assembly 64 includes a heated fuser roller 66 adapted to be pressure engaged with a backup roller 68 with the toner powder images contacting fuser roller 66. In this manner, the toner powder image is permanently affixed to the sheet.

After fusing, copy sheets are directed to catch tray, not shown or a finishing station for binding, stapling, collating etc., and removal from the machine by the operator. Alternatively, the sheet may be advanced to a duplex tray (not shown) from which it will be returned to the processor for receiving a second side copy. A lead edge to trail edge reversal and an odd number of sheet inversions is generally required for presentation of the second side for copying. However, if overlay information in the form of additional or second color information is desirable on the first side of the sheet, no lead edge to trail edge reversal is required. Of course, the return of the sheets for duplex or overlay copying may also be accomplished manually.

Residual toner and debris remaining on photoreceptor belt 10 after each copy is made, may be removed at cleaning station F with a cleaning system 70. The photoreceptor belt 10 is supported by an acoustic transfer assist area 130.

Figure 1:
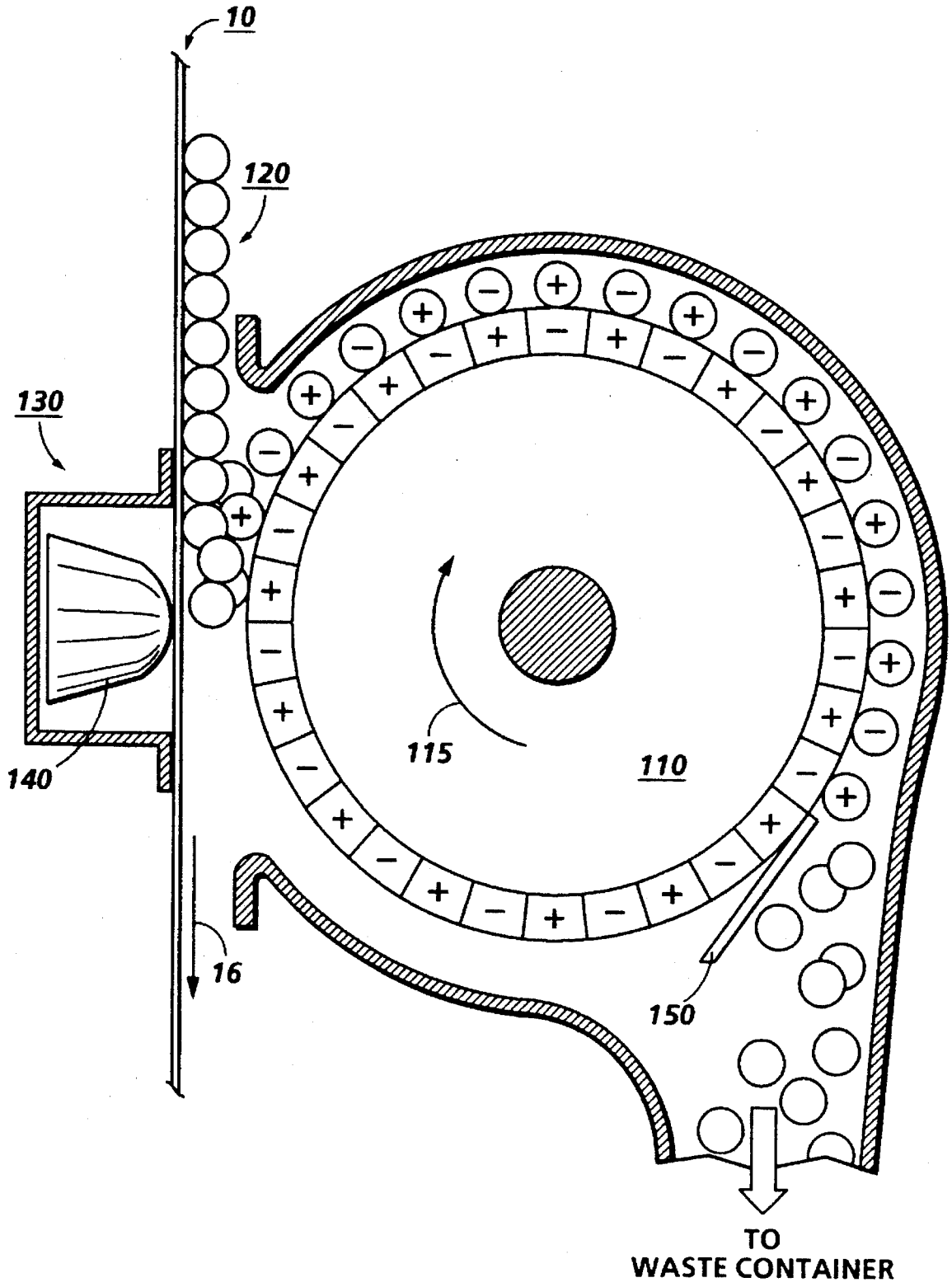
FIG. 1 is a schematic illustration of the present invention.

Reference is now made to FIG. 1, which shows an elevational view of the present invention. As non-transferred residual particles 120 remaining on the photoreceptor 10 pass over the ATA (Acoustic Transfer Assist) area 130, the toner's attraction to the photoreceptor belt 10 is substantially lessened due to the high frequency vibrations caused by the acoustical horn 140. The operation of an acoustical horn is described, for example, in Xerox Disclosure Journal, volume 18, no.3, May/June 1993, and is incorporated herein by reference. The invention proposes using a dual polarity commutated roll 110 that electrostatically attracts (both right and wrong signed) toner, after it has been loosened from the photoreceptor 10 by the acoustical horn 140. (The horn 140 can be held in contact with the photoreceptor 10 by suction.) The high frequency vibration of the photoreceptor belt 10 causes the toner particles 120 to form a particle cloud between the photoreceptor 10 and the commutated roll 110. The voltage potentials on the commutated cleaning roll 110 are adjusted such that a more positive attraction (or negative attraction for wrong sign toner) is felt by the negatively charged toner on the grounded photoreceptor belt. For example, a positive 250 volt potential on positive commutations of the cleaning roll create a strong attraction of the negatively charged toner setting on the grounded photoreceptor belt towards the commutated cleaning roll 110. Conversely, a negative 250 volt potential on the negative commutations of the cleaning roll create a strong attraction of the positively charged (wrong sign) toner towards the commutated cleaning roll. With the assistance of the ATA providing the mechanical vibrations necessary to break the bond between the toner and the photoreceptor belt and additionally bouncing the toner some distance "x" from the photoreceptor belt surface, the attraction of the loose toner particles towards the commutated cleaning roll is complete.

With continued reference to FIG. 1, the commutated roll 110 attracts both right and wrong sign toner to adhere to it's surface as it rotates in a direction shown by arrow 115. A scraper blade 150 is placed in contact with the surface of the commutated roll 110 such that as the commutated roll rotates past the scraper blade 150, the particles adhering to the surface of the commutated roll 110 are scraped from the surface into a waste container (not shown). A vertical cleaner position allows the toner to "free fall" into a toner collection container due to gravity Any residual toner and/or debris residual particles that are not attracted to the commutated roll 110 are removed from the photoreceptor downstream from the commutated roll 110 in the direction of motion of the photoreceptor.

The advantage of this apparatus over other cleaning systems is that no contact occurs between the commutated roll and the photoreceptor. With no contact, the life of the photoreceptor and the commutated roll is increased. This device will be used to clean toner from the photoreceptor.

With continuing reference to FIG. 1, the use of ATA 130 yields greater than a 95% transfer efficiency in a cleaner configuration that allows the ATA 10 to be operated at maximum potential. The acoustical horn 140 can be driven at maximum potential because toner registration is not a concern. This would allow for larger gaps between the roll 110 and photoreceptor 10 thus, reducing the need for critical tolerances. The distance "x" of the commutated cleaning roll 110 from the surface of the photoreceptor belt 10 is chosen to minimize the need for critical tolerances. The voltage potentials applied to the commutated cleaning roll are optimized such that the field strength between the commutated roll and the photoreceptor belt are at a maximum and the air break down limit is exceeded. In other words, the voltage is high enough to create a strong attraction of the toner from the photoreceptor belt towards the commutated roll 110 but not strong enough to break down the air between the commutated roll 110 and photoreceptor belt 10 and start arcing. For example, the voltage applied to the commutated roll 110 is in a range from approximately 100 volts (positive or negative) up to the air breakdown limit −100 volts. Thus, the voltage potentials and gap width would be chosen to maximize field strength and minimize the chance of entering the air breakdown limit.

This would be considered a non-contact cleaner because no part of the cleaner is in contact with the photoreceptor 10 at any time. This non-contact cleaner eliminates motion quality problems, reduces photoreceptor drag and reduces emissions. In a multi-pass copier (image-on -image), this cleaner would not have to retract from the photoreceptor belt like conventional contact cleaners. Thus, reducing UMC (Unit Manufacturing Cost) and increasing reliability of the cleaner.

In recapitulation, the dual polarity commutated roll attracts toner and debris particles loosened into a particle cloud from the photoreceptor surface by an acoustical horn. The particles adhere to the commutated roll, whether right or wrong sign, and are removed form the roll, as the roll rotates, by a scraper blade. The particles are collected in a waste container as the particles are removed from the roll surface by the scraper blade. Residual particles not attracted to the commutated roll are removed from the photoreceptor surface by a spots blade.

It is, therefore, apparent that there has been provided in accordance with the present invention, a dual polarity commutated roll electrostatic cleaner with acoustic transfer assist that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. An apparatus for cleaning particles from a surface having a first surface and a second surface, the first surface being opposite the second surface, comprising:

a device, in communication with the first surface, for loosening the particles from the second surface; and roll, positioned adjacent the second surface, for attracting, electrostatically, loosened particles thereto, said roll including a plurality of sebments forming a circumference of said roll with adjacent segments being opposite polarities for attracting having opposite polarities thereto.

2. An apparatus as recited in claim 1, wherein said device applies vibratory energy to the first surface.

3. An apparatus as recited in claim 2, wherein said device comprises an acoustical horn.

4. An apparatus as recited in claim 3, wherein said horn is adjacent to and in contact with the first surface.

5. An apparatus as recited in claim 4, wherein said roll is positioned adjacent to and spaced from the second surface.

6. An apparatus as recited in claim 5, wherein said horn being located adjacent the first surface opposed from said roll.

7. An apparatus as recited in claim 6, wherein said horn forms a cloud of particles in the space between said roll and the second surface.

8. An apparatus as recited in claim 9, further comprising a scraper contacting said roll to remove particles ashering thereto.

9. An apparatus as recited in claim 8, wherein the particles of the particle cloud include negatively charged particles and positively charged particles.

10. An apparatus as recited in claim 9, wherein the negatively charged particles are attracted to the segments of said roll charged to one polarity.

11. An apparatus as recited in claim 10, wherein the positively charged particles from the toner particle cloud are attracted to the segments of said roll charged to the opposite polarity.

* * * * *